US006782583B2

(12) United States Patent
Oh

(10) Patent No.: US 6,782,583 B2
(45) Date of Patent: Aug. 31, 2004

(54) CYCLONE DUST COLLECTING DEVICE FOR A VACUUM CLEANER

(75) Inventor: Jang-keun Oh, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 251 days.

(21) Appl. No.: 10/053,839

(22) Filed: Oct. 22, 2001

(65) Prior Publication Data

US 2002/0066262 A1 Jun. 6, 2002

(30) Foreign Application Priority Data

Nov. 27, 2000 (KR) ..... 2000-70906

(51) Int. Cl.[7] ..... A47L 9/16

(52) U.S. Cl. ..... 15/350; 15/352; 15/353; 55/337; 55/426; 55/429; 55/DIG. 3

(58) Field of Search ..... 15/350, 352, 353; 55/DIG. 3, 337, 429, 459.1, 426

(56) References Cited

U.S. PATENT DOCUMENTS

| | | | | |
|---|---|---|---|---|
| 2,681,124 | A | 6/1954 | Van Der Kolk | |
| 4,996,538 | A | 2/1991 | Brecy et al. | 346/74.3 |
| 5,350,432 | A | 9/1994 | Lee | 55/408 |
| 6,131,239 | A | 10/2000 | White | 15/352 |
| 6,195,835 | B1 | 3/2001 | Song et al. | 15/327.1 |
| 2002/0062531 | A1 | 5/2002 | Oh | |

FOREIGN PATENT DOCUMENTS

| | | |
|---|---|---|
| DE | 0663679 | 7/1938 |
| DE | 19945403 | 6/2000 |
| DE | 0153898 | 8/2002 |
| EP | 0827710 | 3/1998 |
| EP | 1136028 | 9/2001 |
| GB | 2344278 | 6/2000 |
| JP | 11056718 | 3/1999 |
| WO | WO 0074547 | 12/2000 |
| WO | WO 0074548 | 12/2000 |
| WO | WO 0105291 | 1/2001 |
| WO | WO 0107168 | 2/2001 |
| WO | WO 0195780 | 12/2001 |

*Primary Examiner*—Theresa T. Snider
(74) *Attorney, Agent, or Firm*—Ladas & Parry

(57) ABSTRACT

A cyclone dust collecting device for a vacuum cleaner includes a cyclone body and a cyclone housing for separating the contaminants from the air. The cyclone housing includes a cyclone cover and a dust collecting container. The cyclone cover has a cylindrical shape, one end of which is coupled to the cyclone body. The other end is a slanted end with a through-hole formed therein and a centrally located dome-shaped protrusion. The dust collecting container also has a slanted end, which is detachably engaged with the slanted end of the cyclone cover. The other end of the dust collecting container is tapered to correspond with the slanted end of the cyclone cover. The slanted end of the cyclone cover protects a grill in the cyclone dust collecting device during operation and removal of contaminants from the dust collecting container.

12 Claims, 5 Drawing Sheets

CYCLONE DUST COLLECTING DEVICE FOR A VACUUM CLEANER

BACKGROUND OF THE INVENTION

1. Field of the Invention

The present invention relates to a vacuum cleaner, and more particularly to a cyclone dust collecting device, which is mounted on a telescopic extension pipe of a vacuum cleaner, to filter out and collect contaminants of relatively large particles that are drawn into the vacuum cleaner.

2. Description of the Related Art

Generally, a cyclone dust collecting device separates particles from a fluid using centrifugal force. Due to their simple structure and ability to withstand high-temperature and high-pressure environments, cyclone dust collecting devices have been widely used in the industrial fields for a long time. Further, the cyclone dust collecting device is employed in a vacuum cleaner, to first filter and then collect contaminants of relatively larger particles such as pieces of tissue, vinyl, hairs, and the like, from the air that is drawn in through a cleaner brush. The cyclone dust collecting device prevents these larger contaminants from being filtered out at a paper filter, which is disposed inside a dust collecting chamber, thereby extending the life of the disposable paper filter.

FIG. 1 is a perspective view showing an example of a vacuum cleaner equipped with a conventional cyclone dust collecting device.

As shown in FIG. 1, the vacuum cleaner with the conventional cyclone dust collecting device 10 includes a cleaner body 1, a brush 4 for drawing in contaminants, a flexible hose 2 and a telescopic extension pipe 3 for connecting the brush 4 to the cleaner body 1, a paper filter 7 for filtering out the contaminants, and a fan motor 8 for generating a suction force. The cyclone dust collecting device 10 is mounted on a connection portion between the telescopic extension pipe 3 and the flexible hose 2 to filter out larger particle contaminants.

The cyclone dust collecting device 10 for the vacuum cleaner draws air and contaminants through the brush 4 with a suction force generated by the fan motor 8, obliquely into a cyclone housing 13. Various kinds of relatively larger particles of contaminants, such as pieces of tissue, vinyl, hairs, and the like are separated from the air by the centrifugal force, which is caused by a vortex of air. These larger particle contaminants are then collected in the cyclone housing 13. When the clean air reaches the bottom of the cyclone housing 13, it reverses direction and turns into a rising air flow that is expelled to the cleaner body 1 through the flexible hose 2.

During operation of the vacuum cleaner, the orientation of the cyclone dust collecting device 10 may change either intentionally or unintentionally. That is, the cyclone dust collecting device 10 can be tilted or turned upside-down when cleaning higher locations, causing the contaminants collected in the cyclone housing 13 of the cyclone dust collecting device 10, such as tissue, vinyl, hairs, and the like, to fall toward a grill 12 of the cyclone dust collecting device 10. When such reverse flow of contaminant occurs, the contaminants can block the grill 12 of the cyclone dust collecting device 10, thereby decreasing the cleaning efficiency of the vacuum cleaner or disabling its operation. Therefore, blockage of the grill due to a reverse flow of contaminants should be prevented.

Further, since the cyclone housing 13 can be separated from the cyclone body 11 to enable a user to discard the contaminants that have collected in the cyclone housing 13, the grill 12 of the cyclone body 11 will be exposed. The ambient area may get dirty because of the contaminants that have fallen from the grill. Furthermore, the exposed grill 12 can break if it is mishandled.

SUMMARY OF THE INVENTION

The present invention has been made to solve the problems stated above. Accordingly, it is an object of the present invention to provide a cyclone dust collecting device for a vacuum cleaner that prevents contaminants from blocking the grill, regardless of the orientation of the cyclone dust collecting device. It is a further object of the invention that the device does not hinder operation of the vacuum cleaner. Yet another object of the invention is to prevent contaminants from falling off the grill of a cyclone body or preventing the grill from being broken when the collected contaminants are discarded.

The above object is accomplished by a cyclone dust collecting device for a vacuum cleaner according to the present invention, including a cyclone body connected to a telescopic extension pipe of the vacuum cleaner. The cyclone body generates a swirling vortex from an inflow of air and contaminants that have been drawn in. The cyclone dust collecting device further includes a cyclone housing detachably engaged with the cyclone body. The cyclone housing has a slanted partition with a through-hole formed therein. The slanted partition divides an interior of the cyclone housing into an upper space for separating the contaminants from the air by guiding the vortex of air, and a lower space for receiving the contaminants that have been separated from the air.

The cyclone housing includes a cyclone cover having a cylindrical shape, an open upper end engaged with the cyclone body, and a lower closed end that is closed by the slanted partition. The cyclone housing further includes a dust collecting container having an open end detachably engaged with a lower portion of the cyclone cover. The open end of the dust collecting container is slanted to correspond with to the slanted partition of the cyclone cover.

The dust collecting chamber comprises a closed end, which is slanted to correspond to the slanted partition.

The slanted partition of the cyclone cover includes a dome-shaped protrusion formed on a center thereof.

A supporting means is provided to support the cyclone housing with respect to the telescopic extension pipe and prevent separation of the cyclone housing from the cyclone body.

The supporting means includes a fixture member fixed to the telescopic extension pipe, an insertion member movably disposed on the fixture member, and inserted in a recess formed on a lower end of the cyclone housing, and an elastic member for biasing the insertion member into engagement with the recess.

The cyclone housing includes a cyclone cover having a cylindrical shape, an open upper end engaged with the cyclone body, and a lower slanted end, which is slanted at a predetermined angle with respect to the slanted partition. The cyclone housing further includes a dust collecting container having an open end engaged with the lower portion of the cyclone cover by a screw. The dust collecting container receives contaminants that have passed through the through-hole of the slanted partition.

Accordingly, normal cleaning can be performed regardless of the orientation of the vacuum cleaner. The present cyclone dust collecting device prevents damage to the grill and dispersal of collected contaminants from the grill when discarding the contaminants.

BRIEF DESCRIPTION OF THE DRAWINGS

The above object and other features and advantages of the present invention will become more apparent by the following detailed description of a preferred embodiment with reference to the attached drawings, in which.

DETAILED DESCRIPTION OF THE PREFERRED EMBODIMENT

Figure 1:
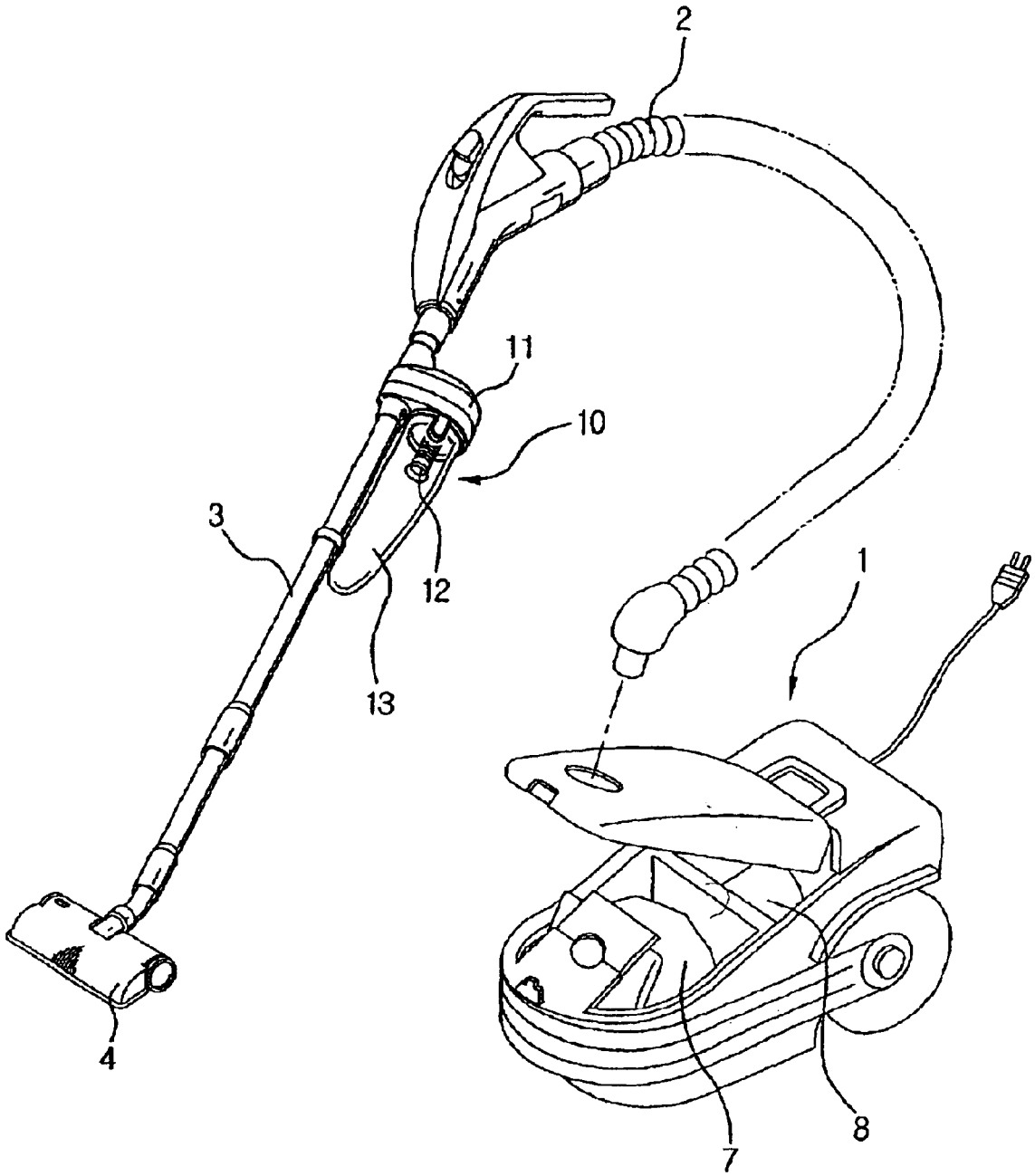
FIG. 1 is a perspective view illustrating a vacuum cleaner having a conventional cyclone dust collecting device.

Hereinafter, a preferred embodiment of the present invention will be described in detail with reference to the accompanying drawings, wherein the like reference numerals refer to like elements.

Figure 2:
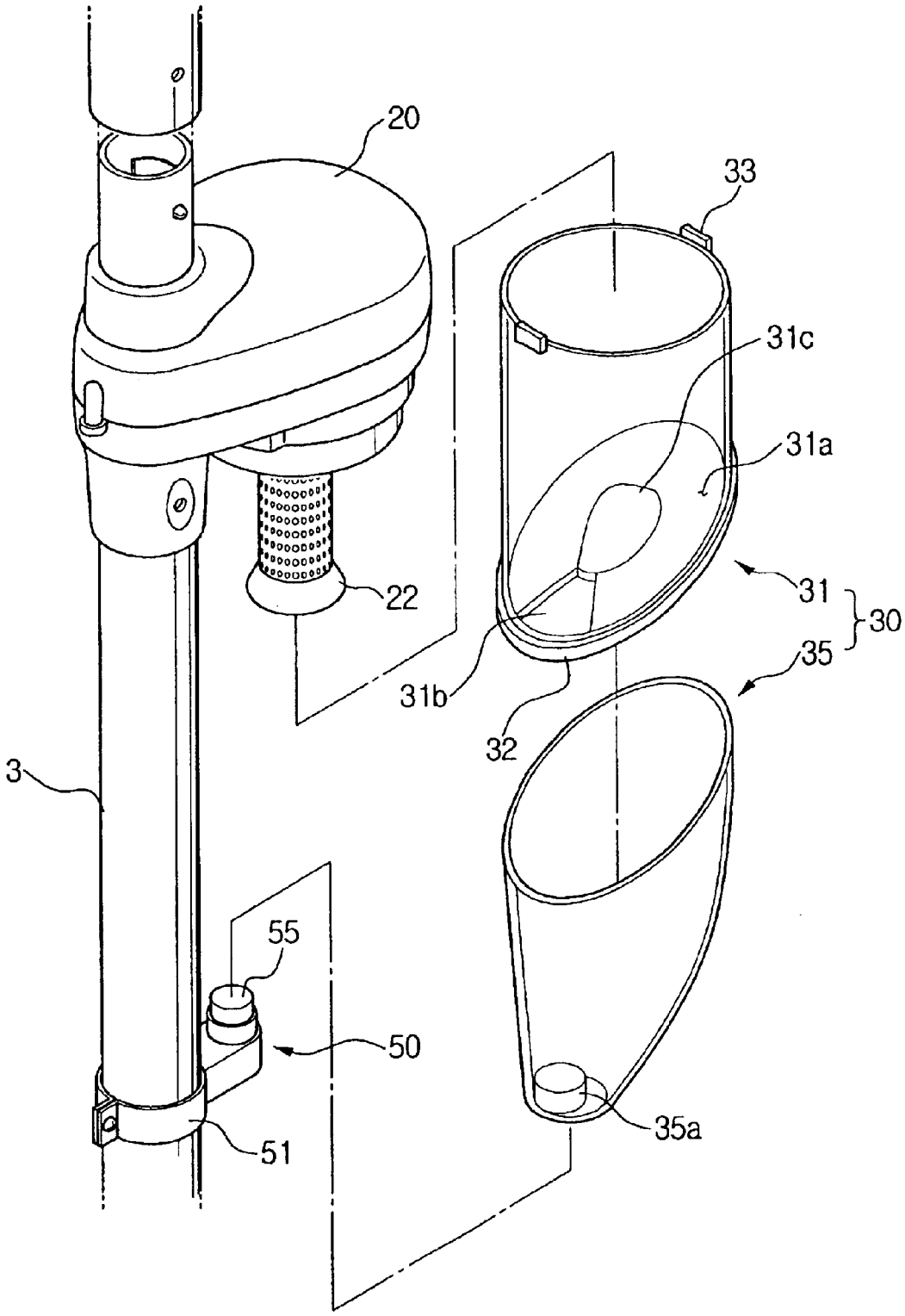
FIG. 2 is an exploded perspective view of a cyclone dust collecting device for a vacuum cleaner according to the present invention.
Figure 3:
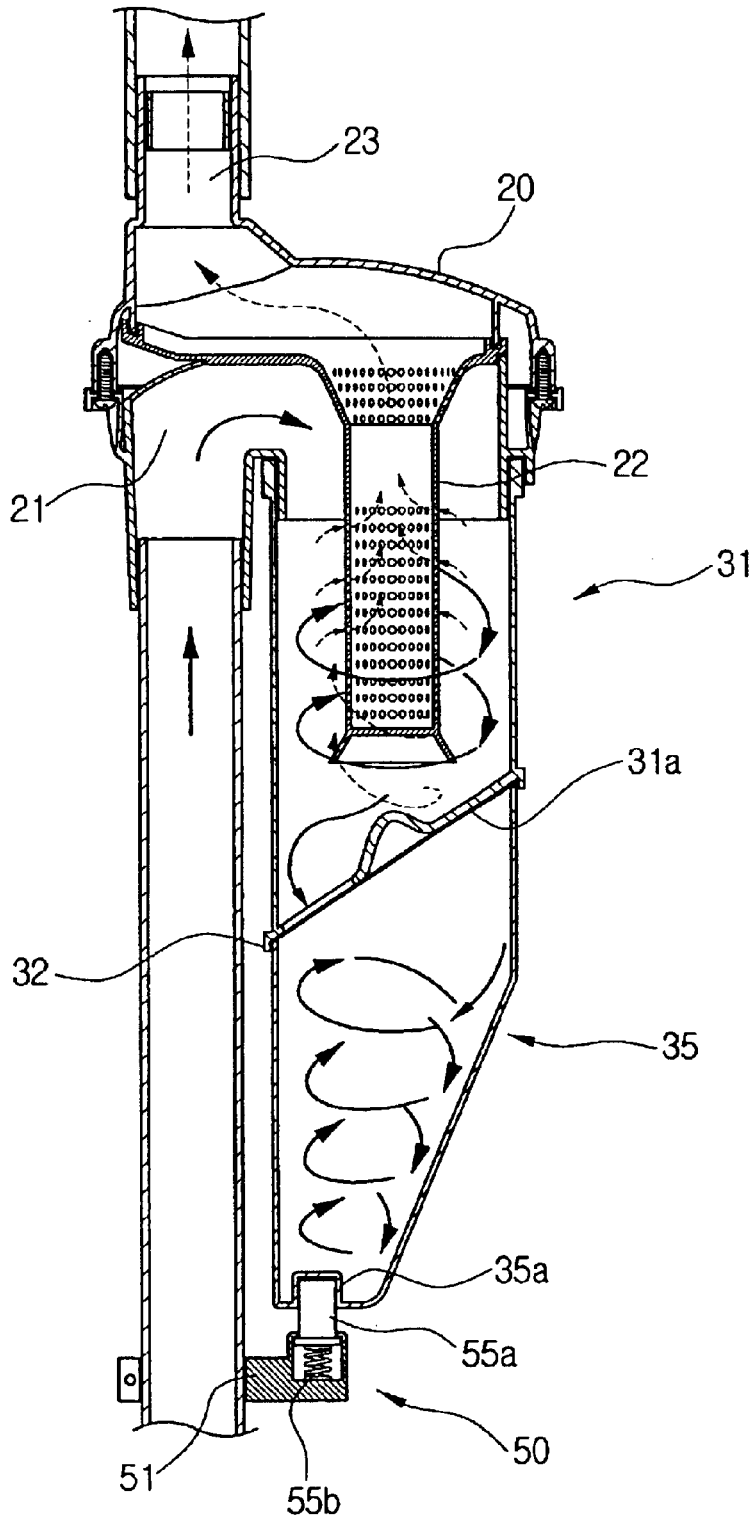
FIG. 3 is a cross-sectional view of the cyclone dust collecting device of FIG. 2.
Figure 4:
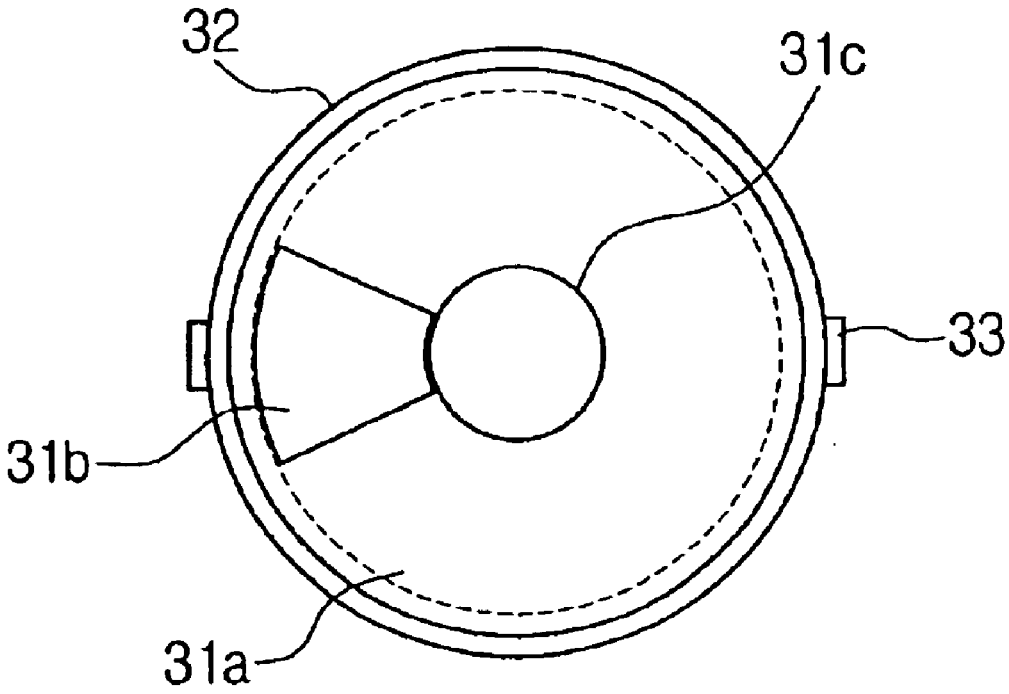
FIG. 4 is a bottom view of a cyclone cover for the cyclone dust collecting device of FIG. 2.

Referring to FIGS. 2 and 3, a cyclone dust collecting device has a cyclone body 20 and a cyclone housing 30. The cyclone housing 30 includes a cyclone cover 31 and a dust collecting container 35. Here, a support part 50 is provided on the telescopic extension pipe 3 of the vacuum cleaner to support the dust collecting container 35 such that the dust collecting container 30 does not detach from the cyclone cover 31 during a cleaning process.

The cyclone body 20 is connected to the telescopic extension pipe 3 of the vacuum cleaner and includes an inflow air passage 21 for obliquely guiding air and contaminants which are drawn in through the brush 4 (FIG. 1), a grill 22 for filtering the air inside the cyclone cover 31, and an outflow air passage 23 for guiding the air that is drawn in through the grill 22 to a cleaner body 1.

The cyclone cover 31 has a cylindrical shape and is connected to a lower portion of the cyclone body 20. The cylindrical shape of the cyclone cover 31 induces the air that is drawn in from the inflow air passage 21 of the cyclone body 20 into a vortex. One end of the cyclone cover 31 has a plurality of engagement protrusions 33 formed therein for connection with the cyclone body 20. The other end of the cyclone cover 31 is a slanted end 31*a*.

The slanted end 31*a* includes a through-hole 31*b* formed therein for guiding the contaminants into the dust collecting container 35. The through-hole 31*b* may be formed by cutting away a portion of the slanted end 31*a* of the cyclone cover 31 in a circumferential direction of the cyclone cover 31 to a predetermined length. Here, the length of the through-hole 31*b* can vary according to the size of the cyclone dust collecting device. The slanted end 31*a* is on an incline that guides the contaminants, which have been separated from the vortex of swirling air, to the dust collecting container 35, along with a certain portion of the swirling air. Preferably, the slanted end 31*a* is inclined at an angle ranging from 15° to 30° with respect to a vertical cross section of the cylindrical cyclone cover 31.

Further, an engagement part 32 having a stepped shape is formed around the slanted end 31*a*. The engagement part 32 secures the cyclone cover 31 to the dust collecting container 35.

According to another embodiment, a dome-shape protrusion 31*c* is extends from a center of the slanted end 31*a*, for efficiently guiding the contaminants to the dust collecting container 35. The diameter of the dome-shape protrusion 31*c* can vary depending on circumstances, but preferably ranges from approximately one-fourth to one-third of the diameter of the cyclone cover 31.

The dust collecting container 35 is engaged with the engagement part 32 of the cyclone cover 31. The dust collecting container 35 has a substantially cylindrical shape and a closed end. The open end of the dust collecting container 35 is slanted to correspond with the slanted end 31*a* of the cyclone cover 31, so that the cyclone cover 31 and the dust collecting container 35 are flush and form a straight line when engaged with each other. Further, a recess 35*a* is formed in the lower portion of the closed end of the dust collecting container 35 to receive the support part 50 for supporting the dust collecting container 35.

Preferably, to reduce the swirling vortex of air from the cyclone cover 31 and also to facilitate a user in mounting the dust collecting container 35 onto the telescopic extension pipe 3, the closed end of the dust collecting container 35 is slightly tapered to have a smaller area than that of the open end, which corresponds to the slanted end of the cyclone cover 31.

The recess 35*a* formed on the lower portion of the closed end of the dust collecting container 35 has a shape and a size which correspond to an insertion part 55 of the support part 50. The recess 35*a* receives the insertion part 55 of the support part 50 to secure the dust collecting container 35 to the telescopic extension pipe 3.

The support part 50 further includes a fixture member 51 that is mounted to the telescopic extension pipe 3. A circular clamp of a size corresponding to the outer diameter of the telescopic extension pipe 3 is provided at one end of the fixture member 51 to engage the telescopic extension pipe 3. The insertion part 55 mounted to the other end of the fixture member 51.

The insertion part 55 includes a pin 55*a*, which is inserted in the recess 35*a* of the dust collecting container 35, and a compression coil spring 55*b* for biasing the pin 55*a* outward. The pin 55*a* and the compression coil spring 55*b* have proper lengths to smoothly separate the dust collecting container 35 from the engagement part 32 of the cyclone cover 31, when a user holds and presses down the dust collecting container 35, and to prevent separation of the dust collecting container 35 from the cyclone cover 31 during a normal cleaning process.

Figure 5:
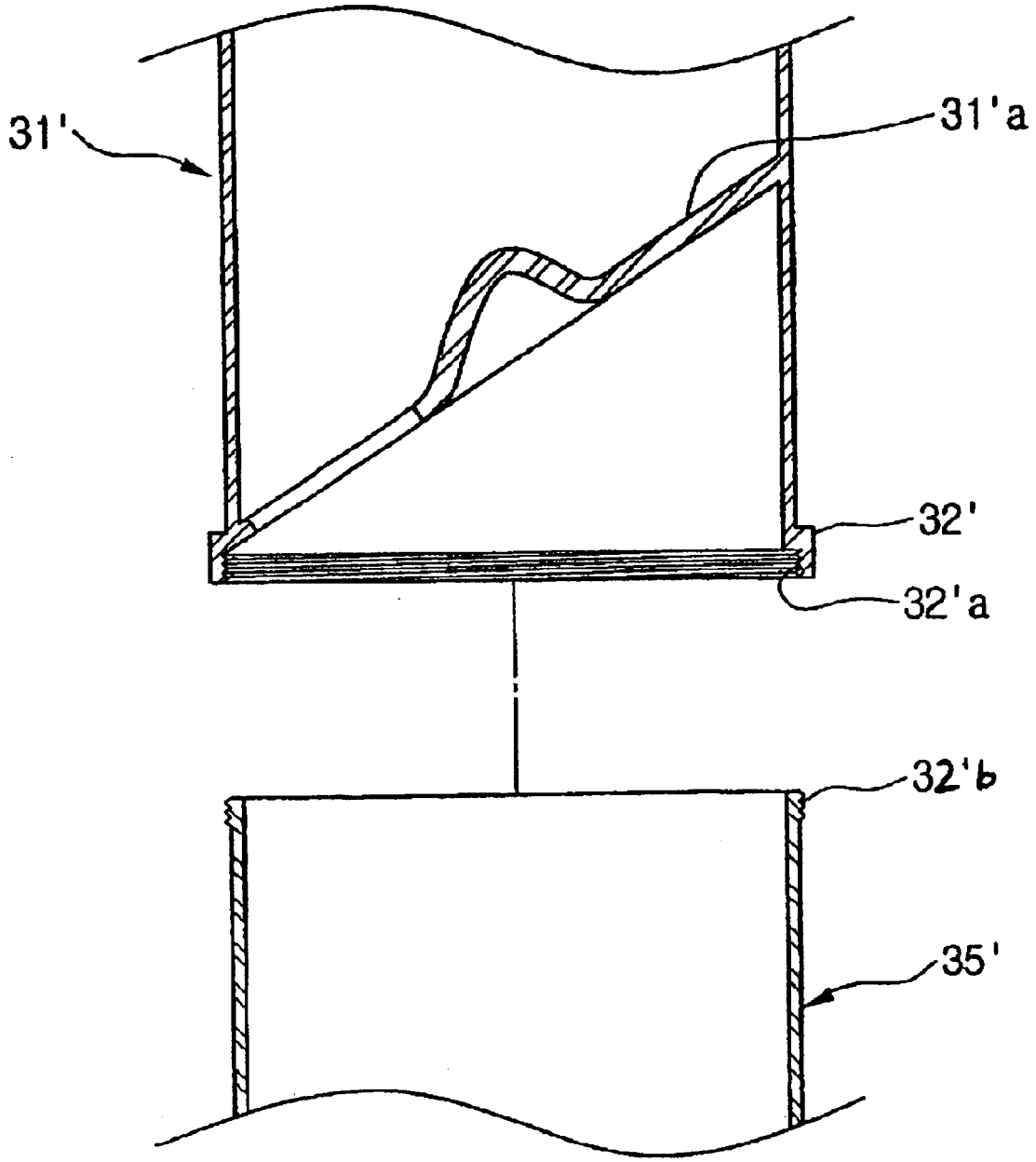
FIG. 5 is a sectional view showing an alternate, screw engagement between the cyclone cover and a dust collecting container of the cyclone dust collecting device of FIG. 2.

Another example of a manner for engaging the dust collecting container 35 with the cyclone cover 31 having a slanted end 31*a*' is shown in FIG. 5. Referring to FIG. 5, an engagement part 32' of a cyclone cover 31' is not formed along the periphery of the slanted end, but formed along the inner periphery of the lower end of the cyclone cover 31'. The engagement part 32' of the cyclone cover 31' is formed with a female screw 32'*a*, and the outer periphery of the open end of the dust collecting container 35' is formed with a male screw 32'*b* for engagement with the female screw 32'*a*. Accordingly, the dust collecting container 35' is connected to the cyclone cover 31' as the engagement part 32' of the cyclone cover 31' is screwed with the dust collecting container 35'. According to this engaging manner, the support part 50 can be omitted.

Hereinafter, the operation of the cyclone-collecting device of the present invention will be described in detail.

Air and contaminants are drawn into the vacuum cleaner through the brush 4 and flow into the cyclone dust collecting device through the inflow air passage 21 of the cyclone body 20. As the air and contaminants enter the cyclone cover 31, they form a swirling vortex of air and contaminants. Larger particle contaminants contained in the air are separated from the air by the centrifugal force of the swirling vortex and then dropped on the bottom of the cyclone cover 31. Most of the air that is free of contaminants collides with the slanted end 31*a* of the cyclone cover 31 and reverses direction forming a rising air stream. The rising air stream is expelled to the cleaner body 1 through the grill 22 and the outflow air passage 23.

After the contaminants have been separated from the air by the centrifugal force, the air falls and is discharged in a swirling air flow through the through-hole 31*b* formed in the slanted end 31*a* of the cyclone cover 31. Since the contaminants are blocked by the slanted end 31*a* of the cyclone cover 31, the contaminants in the dust collecting container 35 are not discharged through the cyclone cover 31, but are rotated in the swirling air flow within the dust collecting container 35.

The cyclone cover 31 induces the air into a swirling vortex in cooperation with the cyclone body 30, and separates contaminants from the air using centrifugal force. The through-hole 33 formed in the slanted end 31*a* guides the contaminants into the dust collecting container 35. The dust collecting container 35 serves as a receptacle where the separated contaminants are collected. That is, since a separation part for separating contaminants from the air is separated from a dust collecting part for collecting the contaminants separated from the sucked air, the contaminants separated by the centrifugal force do not flow in a reverse direction toward the grill 22 of the cyclone body 20 and, therefore, cannot block the grill.

Next, a method for emptying the dust collecting container 35, which is filled with the contaminants, will be described. A user holds the dust collecting container 35 and presses down on the lower portion of the dust collecting container 35, which is removably mounted on the support part 50, to compress the compression coil spring 55*b*. This also disengages the engagement part 32 of the cyclone cover 31 from the dust collecting container 35. The user can then remove the dust collecting chamber 35 from the support part 50. After emptying the dust collecting container 35, the user inserts the insertion pin 55*a* of the support part 50 into the recess 35*a* provided in the lower portion of the dust collecting container 35. Then the user presses down on the dust collecting container 35 to compress the coil spring 55*b* and fit the upper portion of the dust collecting container 35 into alignment with the engagement part 32 of the cyclone cover 31. When the user releases the dust collecting container 35, the coil spring 55*b* will expand, urging the dust collecting container 35 into engagement with the engagement part 32 of the cyclone cover 31. Thus, the dust collecting container 35 is supported at one end by the engagement part 32 and at the other end by the support part 50.

Further, in case of a screw-engagement structure, such as that illustrated in FIG. 5, rotation of the dust collecting container 35' counterclockwise separates the dust collecting container 35' from the engagement part 32' of the cyclone cover 31'. Meanwhile, the dust collecting container 35' is re-engaged with the cyclone cover 31' by rotating the dust collecting container 35' clockwise.

As explained above, the cyclone dust collecting device for a vacuum cleaner in accordance with the present invention, improves the cleaning efficiency of the vacuum cleaner, even when the orientation of the cyclone dust collecting device changes during operation. Furthermore, the device provides a safer way of emptying the contents of the dust collecting container, by preventing the dispersal of contaminants from the grill and protecting the grill.

Although the preferred embodiment of the present invention has been described, it will be understood by those skilled in the art that the present invention should not be limited to the described preferred embodiment. Various changes and modifications can be made within the spirit and scope of the present invention as defined by the appended claims.

What is claimed is:

1. A cyclone dust collecting device for a vacuum cleaner, comprising:

a cyclone body for connection to a telescopic extension pipe of the vacuum cleaner, the cyclone body generating a swirling vortex from an inflow of air and contaminants; and a cyclone housing detachably engaged with the cyclone body, the cyclone housing having a slanted partition with a through-hole formed therein, the slanted partition dividing an interior of the cyclone housing into an upper space for separating the contaminants from the air by guiding the swirling vortex of air and a lower space for receiving the contaminants that have been separated from the air, and a cyclone cover having a cylindrical shape, an open upper end, a lower closed end disposed at a lower portion of the cyclone cover, the open upper end being engaged with the cyclone body, the lower closed end being closed by the slanted partition, and a dust collecting container detachably engaged with the lower portion of the cyclone cover, the dust collecting container having an open end that is slanted to correspond with the slanted partition of the cyclone cover.

2. The cyclone dust collecting device as claimed in claim 1, wherein the dust collecting container comprises a closed end which is slanted to correspond to the slanted partition.

3. The cyclone dust collecting device as claimed in claim 1, further comprising supporting means for supporting the cyclone housing with respect to the telescopic extension pipe and preventing separation of the cyclone housing from the cyclone body.

4. The cyclone dust collecting device as claimed in claim 3, wherein the supporting means comprises:

a fixture member mounted to the telescopic extension pipe;

an insertion member movably disposed on the fixture member, the insertion member being received in a recess formed in a lower end of the cyclone housing, when the cyclone housing is coupled to the cyclone body; and an elastic member for biasing the insertion member into engagement with the recess.

5. The vacuum cleaner as claimed in claim 4, wherein the supporting means comprises: a fixture member mounted to the telescopic extension pipe; an insertion member movably disposed on the fixture member, the insertion member being received in a recess formed in a lower end of the cyclone housing, when the cyclone housing is coupled to the cyclone body; and an elastic member for biasing the insertion member into engagement with the recess.

6. The cyclone dust collecting device as claimed in claim 1, wherein the cyclone housing comprises:

a cyclone cover having a cylindrical shape, an open upper end, and a lower end, the open upper end being engaged with the cyclone body, the lower end being slant with respect to the slanted partition at a predetermined angle; and a dust collecting container having an open end engaged with a lower portion of the cyclone cover by a screw, the dust collecting container receiving the contaminants that have passed through the through-hole of the slanted partition.

7. A cyclone dust collecting device for a vacuum cleaner, comprising:

a cyclone body for connection to a telescopic extension pipe of the vacuum cleaner, the cyclone body generating a swirling vortex from an inflow of air and contaminants; and a cyclone housing detachably engaged with the cyclone body, the cyclone housing having a slanted partition with a through-hole formed therein, the slanted partition dividing an interior of the cyclone housing into an upper space for separating the contaminants from the air by guiding the swirling vortex of air and a lower space for receiving the contaminants that have been separated from the air, wherein the slanted partition includes a dome-shaped protrusion formed on a center thereof.

8. A vacuum cleaner comprising:

a cleaner body, including a suction creating device;

a telescopic extension pipe coupled to the cleaner body via a flexible hose;

a cyclone dust collecting device mounted to the telescopic extension pipe, the cyclone dust collecting device including:

a cyclone body mounted on the telescopic extension pipe, the cyclone body generating a swirling vortex from an inflow of air and contaminants caused by the suction creating device; and a cyclone housing detachably engaged with the cyclone body, the cyclone housing having a slanted partition with a through-hole formed therein, the slanted partition dividing an interior of the cyclone housing into an upper space for separating the contaminants from the air by guiding the swirling vortex of air and a lower space for receiving the contaminants that have been separated from the air, the cyclone housing further comprising:

a cyclone cover having a cylindrical shape, an open upper end, and a lower closed end disposed at a lower portion of the cyclone cover, the open upper end being engaged with the cyclone body, the lower closed end being closed by the slanted partition: and a dust collecting container detachably engaged with a lower portion of the cyclone cover in the lower space, the dust collecting container having an open end that is slanted to correspond with the slanted partition of the cyclone cover.

9. The vacuum cleaner as claimed in claim 8, wherein the dust collecting container comprises a closed end which is slanted to correspond to the slanted partition.

10. The vacuum cleaner as claimed in claim 8, wherein the slanted partition includes a dome-shaped protrusion formed on a center thereof.

11. The vacuum cleaner as claimed in claim 8, further comprising supporting means for supporting the cyclone housing on the telescopic extension pipe and preventing separation of the cyclone housing from the cyclone body.

12. The cyclone dust collecting device as claimed in claim 8, wherein the cyclone housing comprises: a cyclone cover having a cylindrical shape, an open upper end, and a lower end, the open upper end being engaged with the cyclone body, the lower end being slant with respect to the slanted partition at a predetermined angle; and a dust collecting container having an open end engaged with a lower portion of the cyclone cover by a screw, the dust collecting container receiving the contaminants that have passed through the through-hole of the slanted partition.

* * * * *